US005876312A

United States Patent [19]

McClendon

[11] Patent Number: 5,876,312

[45] Date of Patent: Mar. 2, 1999

[54] EXERCISE WALKING STICK

[76] Inventor: Gilbert M McClendon, 1359 N. Calhoun St., Baltimore, Md. 21217

[21] Appl. No.: 843,142

[22] Filed: Apr. 28, 1997

[51] Int. Cl.[6] ..... A63B 21/08

[52] U.S. Cl. ..... 482/93; 482/74; 482/106

[58] Field of Search ..... 482/106, 108, 482/109, 93, 74, 91, 92

[56] References Cited

U.S. PATENT DOCUMENTS

| | | | |
|---|---|---|---|
| 3,171,652 | 3/1965 | Newman . | |
| 3,781,007 | 12/1973 | Baker et al. . | |
| 3,820,781 | 6/1974 | Kane . | |
| 3,874,660 | 4/1975 | Brethen . | |
| 4,218,057 | 8/1980 | Wilson . | |
| 4,278,248 | 7/1981 | Kifferstein . | |
| 4,345,750 | 8/1982 | Lo Voi . | |
| 4,351,348 | 9/1982 | Axton | 482/74 |
| 4,440,391 | 4/1984 | Saenz, Jr. et al. . | |
| 4,480,828 | 11/1984 | Kifferstein . | |
| 4,513,963 | 4/1985 | Nelson et al. . | |
| 4,634,121 | 1/1987 | Sasaki . | |
| 4,664,373 | 5/1987 | Hait . | |
| 4,688,788 | 8/1987 | Olufs . | |
| 4,722,523 | 2/1988 | Yang . | |
| 4,743,016 | 5/1988 | Van Derworp et al. . | |
| 4,819,935 | 4/1989 | Dirksing et al. . | |
| 4,878,673 | 11/1989 | Pollard . | |
| 4,929,211 | 5/1990 | Resnick et al. . | |
| 5,244,445 | 9/1993 | Amesquita | 482/109 |
| 5,312,314 | 5/1994 | Stephan et al. | 482/93 |
| 5,364,325 | 11/1994 | Matthews | 482/93 |
| 5,393,284 | 2/1995 | Wesley | 482/106 |
| 5,653,665 | 8/1997 | Neely | 482/106 |

*Primary Examiner*—Jerome W. Donnelly
*Attorney, Agent, or Firm*—Law Offices of Royal W. Craig

[57] ABSTRACT

An improved exercise walking stick for hand-held or strap-on use by a walker which simultaneously provides a walker or jogger with an enhanced adjustable muscular and aerobic workout, a means for enhancing the walker's visibility, and a means of protecting the walker against unwanted aggressors such as thieves or animals.

4 Claims, 3 Drawing Sheets

EXERCISE WALKING STICK

FIELD OF THE INVENTION

The present invention relates generally to exercising accessories, and more particularly to an improved exercise walking stick for hand-held or strap-on use by a walker which simultaneously provides a walker or jogger with an enhanced adjustable muscular and aerobic workout, a means for enhancing the walker's visibility, and a means of protecting the walker against unwanted aggressors such as thieves or animals.

BACKGROUND OF THE INVENTION

The benefits of low-impact aerobic exercises have become well known to exercise enthusiasts over the past several years. Sports such as walking, swimming, and bicycling offer many of the same benefits as high impact forms of exercise, but do not place as much strain on the participant's body. Walking has always been advocated as a beneficial health measure, and is currently the most popular form of exercise. In fact, recent polls show that some 100 million people walk for exercise. Low impact walking exercises provide a means of exercise for nearly everyone, regardless of age or cardiovascular condition. Walking exercises serve to strengthen the heart and lungs, making them work more efficiently. Studies have shown that this easy to perform, natural activity can provide powerful health benefits including reduced anxiety, weight loss, reduced cholesterol levels, controlled hypertension, improved cardiovascular health, and slowed aging. Walking exercises also improve muscle and skeletal strength, particularly in the walker's arms and legs. Walking exercises much of the walker's body to at least some extent, though walkers have found it advantageous to enhance the workout to the walker's upper body and to increase the muscular workout available to the walker's lower body. The recent increase in interest and participation in walking exercises has led to the development of exercising accessories to be used in conjunction with a walker's or light jogger's workout. More particularly, walkers have desired to incorporate into their walking routine some form of enhanced muscular exercise, allowing them to build muscle mass to a greater extent than if they were walking unassisted. To this end, walkers have in the past carried free weights while they walk in order to provide some upper body muscular workout during their walking routine.

One drawback to walking exercises is the fact that it is usually practiced outdoors. Thus, the walker's security is entirely dependent on the security of the walker's neighborhood. Even those who exercise in a health club or gym can place themselves at risk when they walk from the gym to their car or to a bus stop after dark. Likewise, if the walker is walking outdoors after sundown, they always run the risk of a dangerous confrontation with traffic if they are not properly illuminated. To alleviate these problems, walkers will at times carry a simple walking stick which can serve to provide some means of defense against would be attackers, and a flashlight to indicate their presence to traffic.

SUMMARY OF THE INVENTION

The present invention meets the needs of walkers to have a variable weight device for exercising various muscle groups of the body during their walking routine, while offering a safety device to dissuade would be attackers and to show their presence to passing traffic. The present invention provides joggers, exercise walkers, and others with a means of conveniently carrying a variable weight, sectional walking and self defense stick incorporating a means of illumination during their exercise routine. The present invention is used for balance and support, and can be used as a club for personal security against animals and other would be attackers. The sectional stick may either be carried or strapped on to the user's extremities and worn as weights, thus increasing the walker's exercise benefits by providing greater resistance and making the body work harder to move its extremities. The placement of a user defined amount of weight in each of the sections allows the walker the flexibility to vary the dynamic motion of the walking stick to offer greater or lesser resistance to the walker's natural limb movements, in turn providing a wide variety of exercising effects to the various parts of the walker's body. Likewise, reflectors and bright colors are provided on the walking stick in order to illuminate the walker to traffic.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
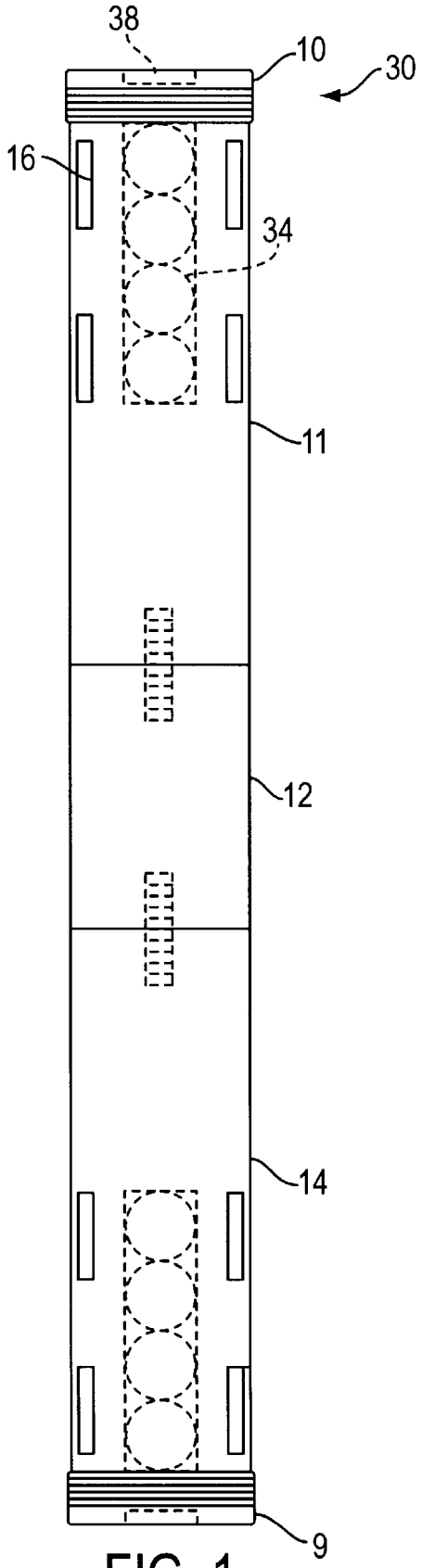
FIG. 1 is a perspective view of the fully assembled exercise walking stick of the present invention.
Figure 2:
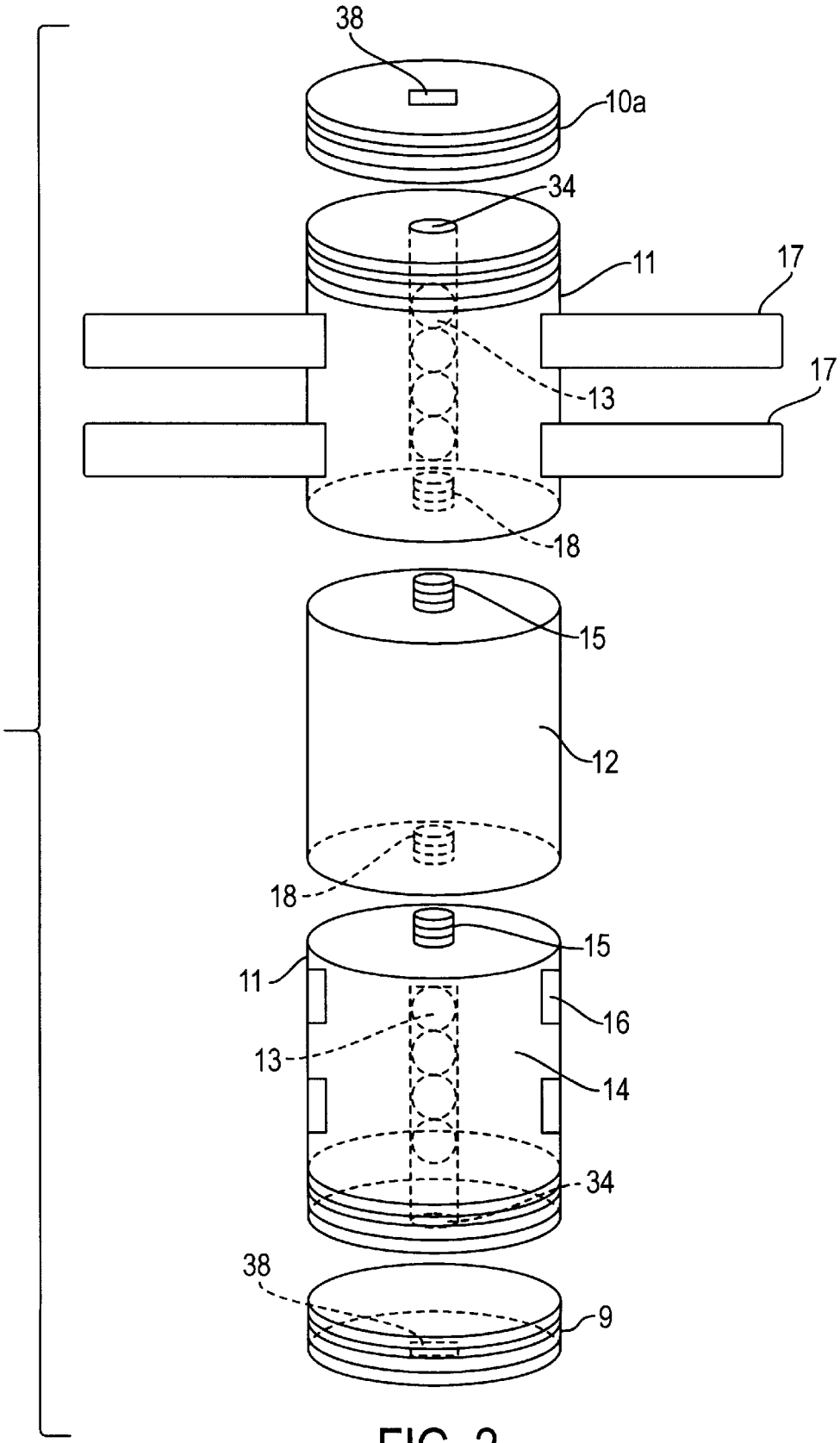
FIG. 2 is a fragmentary, sectional view of the exercise walking stick of the present invention.
Figure 3:
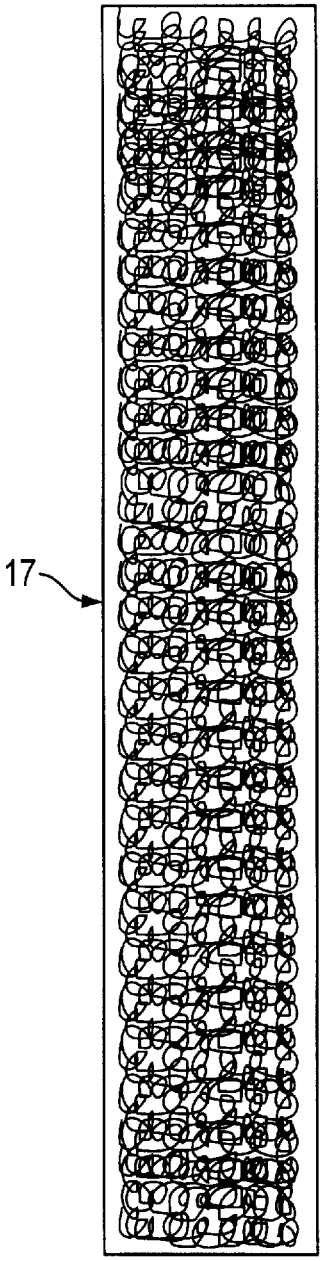
FIG. 3 is a close up view of a two sided hook and loop fastening material strap of the present invention.
Figure 4:
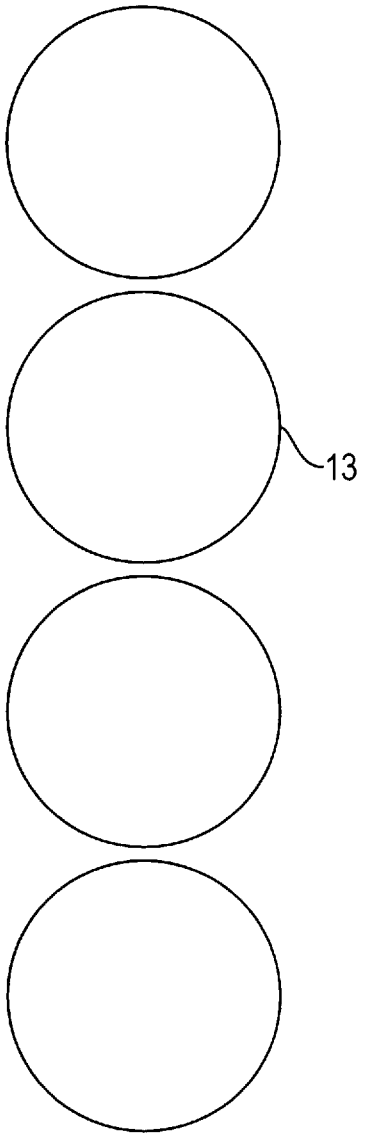
FIG. 4 is a close up side view of the weighted steel balls of the present invention.

FIG. 1 is a perspective view of the fully assembled exercise walking stick 30 of the present invention. As shown more particularly in FIG. 2, the exercise walking stick 30 is comprised of numerous sections, including a top cap 10, a top weight receiving section 11, a middle extension section 12, a bottom weight receiving section 14, and a bottom cap 9, each of which are described in detail below.

The top end of the exercise walking stick 30 is an internally threaded top screw cap 10. Top screw cap 10 is provided at its top face with a slot 38 for assisting in the closing and sealing of a ball chamber 34 (discussed below), such as by engagement with a screwdriver. Directly below top cap 10 is a top weight receiving section 11 comprised of a lightweight polyvinyl chloride or plastic, and is approximately 12 inches in length. Top weight receiving section 11 is provided at its top perimeter with external threads which receive top cap 10. The outer surface of top weight receiving section 11 is colored in either a variety of flourescent colors or a reflective material, allowing the stick, and thus the user, to readily be seen in any poorly lit area by oncoming traffic and by other pedestrians, regardless of the weather conditions or the time of day. The top wall of top weight receiving section 11 is provided with an opening allowing access to a cylindrical weighted ball chamber 34 running along the central axis of top weight receiving section 11. Ball chamber 34 extends only partially along the length of top weight receiving section 11, leaving enough room at its base to provide a female threaded channel 18 on the bottom face of top weight receiving section 11 for connecting other sections of the exercise walking stick to the top weight receiving section 11. During use, the walker may place up to four 1 pound steel balls 13 into weighted ball chamber 34 in order to vary the weight of the fully assembled exercise walking stick or alternatively of the individual, strap-on sections of the exercise walking stick, as explained below.

On the cylindrical sidewall of top weight receiving section 11 are provided channels 16 through the sidewall surface which receive straps 17. Straps 17 are configured as elongated straps of a two-sided hook and loop type fastening material. During use, the exercise walking stick may optionally be separated into its above-described sections and attached to the user's limbs using straps 17. For example, if while the user is walking they desire to exercise their upper arms, straps 17 of each of the top weight receiving section 11 and the bottom weight receiving section 14 may be wrapped around the users upper arms and fixed in place by connecting the hook and loop fastening material of the opposing free ends of straps 17. Likewise, should the user desire to increase the work out on their legs, straps 17 of each of the sections may be similarly wrapped around the walker's thighs. Because their is no buckle type structure and the entire strap 17 is composed of hook and loop material, straps 17 may readily be used for any diameter limb up to the length of strap 17, and may be quickly applied and removed as necessary, such as when needed to defend against a would be attacker.

Top weight receiving section 11 is provided on its bottom face with a female threaded channel 18 along the central axis of top weight receiving section 11. Female threaded channel 18 allows top weight receiving section 11 to be threadably attached either to bottom weight receiving section 14 or to a middle extension section 12, as discussed below.

Middle extension section 12 is provided at its top face with a male threaded connector 15 which is optionally threadably received by female threaded channel 18 on top weight receiving section 11. Likewise, middle extension section 12 is provided at its lower face with a second female threaded channel 18, identical to that on the bottom face of top weight receiving section 11, configured to optionally threadably receive a second male threaded connector 15 located on the top face of bottom weight receiving section 14.

Bottom weight receiving section 14 is identical in construction to top weight receiving section 11, with the exception that the bottom weight receiving section 14 is provided with a male threaded connector 15 at its top face for attachment to top weight receiving section 11 or optionally to middle extension section 12. Otherwise, bottom weight receiving section is provided with an identical ball chamber 34 for receiving up to four 1 pound steel balls 13 for varying the weight of the bottom weight receiving section 14, and is provided around its bottom perimeter with external threads for receiving an internally threaded bottom cap 9 for closing off ball chamber 34.

During use, the walker thus has the option of using the exercise walking stick in its disassembled state whereby the top and bottom weight receiving sections are provided with the preferred weights and strapped on the walker's extremities using straps 17. Otherwise, should the walker desire to utilize the exercise walking stick in its assembled form to provide a stronger work out for either of the walker's arms, they may threadably attach the bottom weight receiving section 11 to the top weight receiving section 14, providing an assembled exercise walking stick of approximately 24 inches. Because each of the ball chambers 34 may receive anywhere from zero to four steel balls 13, the fully assembled stick is provided with an overall weight of from 1 to 10 pounds. For taller walkers with a longer arm span, intermediate sections 12 may be provided between the top and bottom weight receiving sections, allowing the overall exercise walking stick to be adjusted to any desired length.

Because the user may freely select the amount of weight to place in either of the weight receiving sections of the stick, the user may readily vary the dynamic motion of the exercise walking stick while in use, and thus the overall exercising effect of the stick. For example, increasing the amount of weight in one portion of the fully assembled stick while decreasing the weight in the other section will provide both a modified rhythm to the natural swinging movement of the stick, as well as a modified force distribution to vary the effects on different parts of the user's limbs, allowing the user to adjust the stick for both their desired workout and desired comfort level.

The exercise walking stick of the present invention thus combines a convertible carried variable weight system with a visibility enhancing means, a walking aid, and a self defense aid in one convenient device which may easily be carried by one hand or alternatively strapped on to the limbs of the user. Thus, the present invention eliminates the need to use a bulky backpack or belt pouch to carry separate gear for performing these functions during walking exercises, allowing the walker greater flexibility in movement and freeing them of the distraction of carrying various articles during their exercises. Likewise, the present invention makes each of these features always available, including an effective means of protecting the walker from unwanted aggressors.

I claim:

1. A convertible, variable weight exercise walking stick convertible from an elongate hand carried walking stick into multiple strap-on weight accessories for a user's limbs, comprising:

a first weight receiving section having a longitudinal axis and a first outer surface, said first weight receiving section further comprising a first longitudinal bore partially extending through the interior of said first weight receiving section for receiving a user-defined amount of removable weight;

at least one first pair of longitudinally extending channels on said outer surface; and an elongate fastening strap extending through each said first pair of longitudinally extending channels perpendicular to said longitudinal axis for selectively attaching said first weight receiving section to one of a user's upper arm, lower arm, upper leg, and lower leg, such that the longitudinal axis of said first weight receiving section is parallel to the longitudinal axis of the user's selected limb;

a second weight receiving section independent of said first weight receiving section having a longitudinal axis and a second outer surface, said second weight receiving section further comprising a second longitudinal bore partially extending through the interior of said second weight receiving section for receiving a user-defined amount of removable weight;

at least one weight means being positioned in each of said first and second longitudinal bores;

at least one second pair of longitudinally extending channels on said second outer surface; and an elongate fastening strap extending through said second pair of longitudinally extending channels perpendicular to said longitudinal axis for selectively attaching said second weight receiving section to one of a user's upper arm, lower arm, upper leg, and lower leg, such that the longitudinal axis of said second weight receiving section is parallel to the longitudinal axis of the user's selected limb; and means for threadably attaching said first weight receiving section directly to said second weight receiving section such that said first and second weight receiving sections are in abutment with one another;

whereby the placement of said weight means in each of said first and second bores allows a user to vary the positioning of loads on the user's limbs and in turn the rhythmic dynamic and overall exercising effect of the exercise walking stick.

2. The convertible, variable weight exercise walking stick of claim 1, further comprising:

a first end cap for closing said first bore in said first weight receiving section, said first end cap provided with internal threads and said first weight receiving section provided on its periphery with external threads for removable attachment of said first end cap to said first weight receiving section for allowing selective access to and sealing of said first bore; and a second end cap for closing said second bore in said second weight receiving section, said second end cap provided with internal threads and said second weight receiving section provided on its periphery with external threads for removable attachment of said second end cap to said second weight receiving section for allowing selective access to and sealing of said second bore.

3. The convertible, variable weight exercise walking stick of claim 1, further comprising:

at least one intermediate extension section disposed between said first weight receiving section and said second weight receiving section, said intermediate extension section further comprising means for threadably attaching said intermediate extension section simultaneously to said first weight receiving section and to said second weight receiving section for selectively increasing the overall length of the convertible, variable weight exercise walking stick.

4. The convertible, variable weight exercise walking stick of claim 1, wherein said first weight receiving section and said second weight receiving section further comprise means for illuminating the variable weight exercise walking stick.

* * * * *